US006443166B1

(12) United States Patent
Tunney et al.

(10) Patent No.: US 6,443,166 B1
(45) Date of Patent: Sep. 3, 2002

(54) METHOD OF CLEANING A PRESSURIZED CONTAINER

(75) Inventors: Joseph P. Tunney, Evanston, IL (US); Paul Buchan, Regina Saskatchewan (CA)

(73) Assignee: General Electric Company, Schenectady, NY (US)

( * ) Notice: Subject to any disclaimer, the term of this patent is extended or adjusted under 35 U.S.C. 154(b) by 90 days.

(21) Appl. No.: 09/689,386

(22) Filed: Oct. 12, 2000

(51) Int. Cl.[7] ..... B08B 9/00; B08B 5/00
(52) U.S. Cl. ..... 134/22.1; 134/22.18
(58) Field of Search ..... 134/22.1, 22.15, 134/22.18, 31, 34, 37, 40, 42

(56) References Cited

U.S. PATENT DOCUMENTS

| | | | | |
|---|---|---|---|---|
| 3,873,745 A | | 3/1975 | Rey et al. | |
| 4,469,143 A | * | 9/1984 | Vazin | 134/10 |
| 4,816,081 A | | 3/1989 | Mehta et al. | |
| 5,017,240 A | * | 5/1991 | Brown | 134/10 |
| 5,103,578 A | | 4/1992 | Rickard | |
| 5,343,633 A | | 9/1994 | Wang et al. | |
| 6,289,605 B1 | | 9/1994 | Chang | |
| 5,489,166 A | | 2/1996 | Schmit | |
| 5,513,446 A | | 5/1996 | Neubauer et al. | |
| 5,526,582 A | | 6/1996 | Isaksson | |
| 5,551,165 A | | 9/1996 | Turner et al. | |
| 5,584,939 A | * | 12/1996 | Dahlin et al. | 134/21 |
| 5,591,272 A | * | 1/1997 | Hummer | 134/10 |
| 5,647,143 A | | 7/1997 | Kubota et al. | |
| 5,759,287 A | | 6/1998 | Chen et al. | |
| 6,033,901 A | * | 3/2000 | Powell, Jr. | 134/19 |
| 6,041,793 A | * | 3/2000 | Miyasaki | 134/168 R |
| 6,158,146 A | | 12/2000 | Kieselbach et al. | |
| 6,203,623 B1 | * | 3/2001 | Xia | 134/1 |
| 6,249,990 B1 | | 6/2001 | Tannous et al. | |
| 6,286,230 B1 | | 9/2001 | White et al. | |

* cited by examiner

*Primary Examiner*—Randy Gulakowski
*Assistant Examiner*—Saeed Chaudhry
(74) *Attorney, Agent, or Firm*—McDermott, Will & Emery

(57) ABSTRACT

The present invention relates to a method of cleaning a pressurized container having at least one chemical contained therein. The pressurized container may be any type of container able to store chemicals under pressure. Preferably, however, the container may be a rail tank car. Generally, the method begins with inspecting the container, testing for leaks in the container and verifying the contents of the container. Cleaning the container entails injecting the container with an amount of heated nitrogen gas to commingle with the chemical contained therein. The nitrogen gas/chemical mixture is then fed to a flare for incineration of the chemical. This may be repeated a plurality of times to completely clean the container or reduce the concentration of the chemical therein to a predefined amount. After cleaning with heated nitrogen, the container may be steam-cleaned and opened to remove debris.

20 Claims, 4 Drawing Sheets

SEARCH CONTAINER
10

1
EVIDENCE OF LEAKS ?
YES
NO
SAMPLE SIDE PORT AT DOME
16
EVIDENCE OF LEAKS ?
YES
NO
REMOVE PROTECTIVE FACEMASK FOR SNIFF TEST
20
EVIDENCE OF LEAKS ?
YES
NO
24
OPEN DOME COVER; INSPECT DOME AREA
PROCEED TO HEATED $N_2$ CLEANING
26
ASSESS LEAK; SUBMIT CONTAINER FOR REPAIRS
14

METHOD OF CLEANING A PRESSURIZED CONTAINER

FIELD OF INVENTION

The present invention relates to a method of cleaning a pressurized container having chemicals stored or otherwise contained therein. Specifically, the present invention relates to a method of cleaning pressurized containers such as, for example, rail tank cars, mobile tanks or the like. Further, the chemicals may be any material stored under pressure that may be difficult to collect and dispose of due to the hazardous characteristics thereof.

BACKGROUND OF THE INVENTION

It is, of course, generally known to store and/or transport chemicals having hazardous characteristics via pressurized containers. Further, it is also generally known to clean these containers using a variety of methods and systems. In the past, cleaning pressurized containers entailed venting excess gaseous material to the atmosphere. Further, unpressurized containers contained bottom hatches or valves for draining liquid chemicals. However, many hazardous chemicals escaped into the environment thereby causing health risks for humans, vegetation and wildlife. With the advent of environmental standards and compliance, however, venting or draining hazardous chemicals to the environment has generally become illegal. Today, the chemicals are typically routed to a flare to be incinerated or otherwise collected for disposal.

However, while some of the gases contained within the containers may be relatively easy to recover and dispose of by venting of the pressurized containers to a flare, it is difficult to remove all of the gases contained therein. Further, liquid product may remain inside a container after cleaning. Typical systems and methods of cleaning may involve injecting the container with a quantity of steam that may aid in bringing the liquid chemicals to the gaseous phase. The steam/gaseous chemical product combination is transported from the container for incineration or disposal. However, problems may occur using steam to remove chemicals from pressurized containers since steam may condense within the container forming liquid water or ice. The liquid water or ice may mask the presence of the chemicals from detectors. Further, the liquid water or ice may interfere with the removal of the chemicals from the container.

Another method of removal, especially for unpressurized containers having liquid therein, may include entering the container to manually remove the chemical. While this may be a relatively efficient and thorough way to remove the chemical from the container, it may be very dangerous, as it requires an individual to actually enter the container thereby exposing the individual to the chemicals contained therein. Further, by opening the container, there may be a significant risk that some of the chemicals may escape into the environment.

Therefore, an improved method of cleaning pressurized containers is necessary. Particularly, a method is needed that overcomes the problems associated with typical cleaning methods. Further, a method is needed that cleanly and efficiently moves chemical product from a pressurized container and transports the waste product to a proper disposal system such as a flare for incineration.

SUMMARY OF THE INVENTION

The present invention relates to a method of cleaning a pressurized container having chemicals therein. More specifically, the present invention allows containers such as, for example, rail tank cars, to be cleaned safely and efficiently without risking exposure of the chemicals to people or the environment. The invention entails injecting heated and pressurized nitrogen gas into the container thereby purging the container of any chemical therein to form a nitrogen/chemical mixture. The nitrogen/chemical mixture may then be sent to a flare for incineration. Further, the heated nitrogen gas may aid in pulling the chemical out of the container and transporting the chemical to the flare for incineration.

To this end, in an embodiment of the present invention, a method of cleaning a container having at least one chemical therein is provided, the method comprises providing a container having an amount of at least one chemical contained therein wherein the container has a plurality of valves for adding material to the container or removing material from the container and adding an amount of heated nitrogen gas to the container to mix with the chemical creating a nitrogen gas/chemical mixture. Further, the method comprises providing a flare to incinerate the chemical and venting the nitrogen gas/chemical mixture to the flare.

In an embodiment of the present invention, the chemical is in a gaseous state at standard temperature and pressure and further wherein the chemical has a pressure within the container.

In an embodiment of the present invention, the method further comprises the steps of measuring the pressure within the container prior to adding the heated nitrogen gas and venting the gaseous chemical to the flare.

In an embodiment of the present invention, the method further comprises the step of inspecting the container for leaks.

In an embodiment of the present invention, the method further comprises the step of sampling the hazardous material to verify the identity of the chemical.

In an embodiment of the present invention, the method further comprises the step of attaching a pipe to one of the valves and connecting the pipe to the flare prior to venting the residual pressure of the chemical.

In an embodiment of the present invention, the method further comprises the steps of providing a housing having sideports wherein the housing is disposed over the valves and sampling the gas within the housing for leaks via the sideports of the housing while inspecting the container.

In an embodiment of the present invention, the method further comprises the steps of providing a lid on the housing, opening the lid and inspecting the valves in the housing for damage to the valves.

In an embodiment of the present invention, the temperature of the heated nitrogen gas is between about 100° F. and about 300° F.

In an embodiment of the present invention, the method further comprises the step of attaching a pipe from the nitrogen gas to the inlet valve of the container.

In an embodiment of the present invention, the method further comprises the steps of filling the container with heated nitrogen gas, venting the heated nitrogen gas from the container and repeating filling and venting a plurality of times until the concentration of the chemical therein reaches a predefined amount.

In an embodiment of the present invention, the method further comprises the step of adding heated nitrogen gas until the pressure within the container is between about 5 psi and about 50 psi.

In an embodiment of the present invention, the method further comprises the step of grounding the container prior to inspecting the container.

In an embodiment of the present invention, the method further comprises the steps of providing a means to access the inside of the container and opening the means to access the inside of the container to gain access to the inside of the container.

In an embodiment of the present invention, the method further comprises the steps of providing steam in a steam tank, connecting a pipe from the steam tank to the inlet valve of the container, adding the steam to the container to pressurize the container with the steam, and maintaining the pressure of the steam within the container for an amount of time.

In an embodiment of the present invention, the method further comprises the steps of measuring a residual pressure of the chemical within the container with a pressure gauge prior to adding the amount of heated nitrogen gas, and venting the residual pressure of the hazardous material to the flare.

In an embodiment of the present invention, the method further comprises the step of adding a quantity of heated nitrogen gas if the residual pressure within the container is about zero psi.

In an embodiment of the present invention, the container is a rail tank car.

In an embodiment of the present invention, the container has a plurality of chemicals contained therein.

In an embodiment of the present invention, the method further comprises the steps of providing a control panel having a plurality of controls for controlling the cleaning method and controlling the cleaning method via the control panel.

It is, therefore, an advantage of the present invention to provide a method of cleaning a pressurized container having a quantity of chemicals therein that safely and efficiently removes chemicals from the container. Moreover, it is advantageous that the present invention removes chemicals from the container without risking exposure to people or the environment.

Further, it is an advantage of the present invention to provide a method of cleaning a pressurized container having a quantity of chemicals therein that allows the chemicals to be removed without causing damage to the container by freezing the container or pipes connected thereto. In addition, an advantage of the present invention is that the heated nitrogen gas used to remove the product will not condense within the container and therefore will not mask the presence of the chemicals therein.

Another advantage of the present invention is to provide a method of cleaning a pressurized container having a quantity of chemicals therein that is largely automatic and therefore allows an individual to monitor the process without exposing the individual to the chemicals. Additionally, an advantage of the present invention is that a plurality of types of containers may be cleaned using the method and method defined herein, including, but not limited to, rail tank cars and other like containers.

Additional features and advantages of the present invention are described in and will be apparent from, the detailed description of the presently preferred embodiments and from the drawings.

DETAILED DESCRIPTION OF THE PRESENTLY PREFERRED EMBODIMENTS

The present invention relates to a method of cleaning pressurized containers such as, for example, rail tank cars and the like. More specifically, the present invention provides a method of cleaning pressurized containers that includes, but is not limited to, injecting heated, pressurized nitrogen gas into a container having a quantity of chemicals therein. The nitrogen gas purges the container of the chemical or chemicals contained therein. The chemical or chemicals may then be transported to a flare for incineration or may otherwise be collected for disposal. The flare may be configured to incinerate any number of chemicals as may be apparent to those skilled in the art, such as, for example, liquefied petroleum gas and/or anhydrous ammonia. The present invention allows the containers to be cleaned quickly, safely and efficiently without exposing individuals to undue risk.

Figure 1:
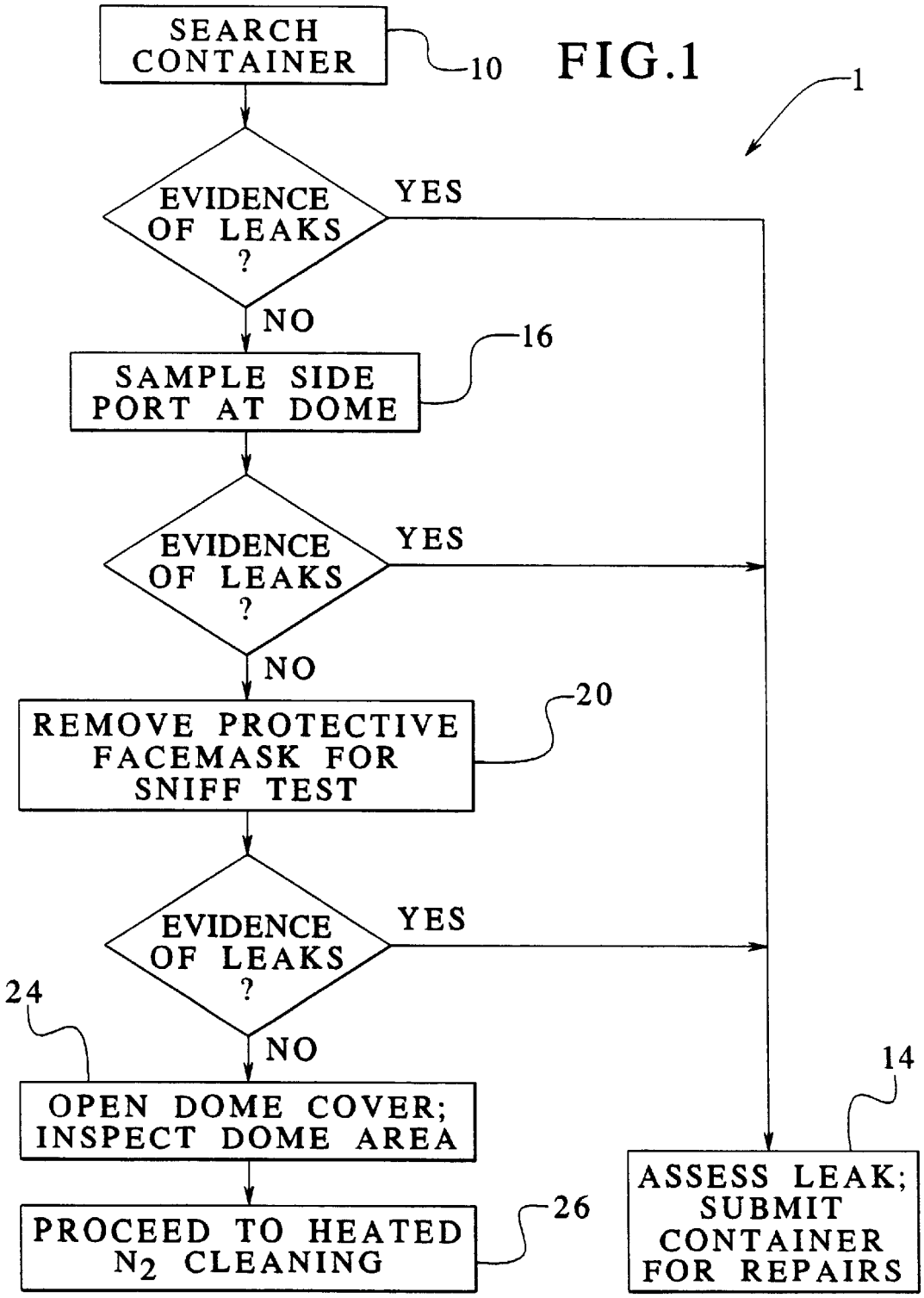
FIG. 1 illustrates an inspection process in an embodiment of the present invention for pressurized containers to be used prior to the cleaning of the containers by the heated nitrogen.
Figure 2:
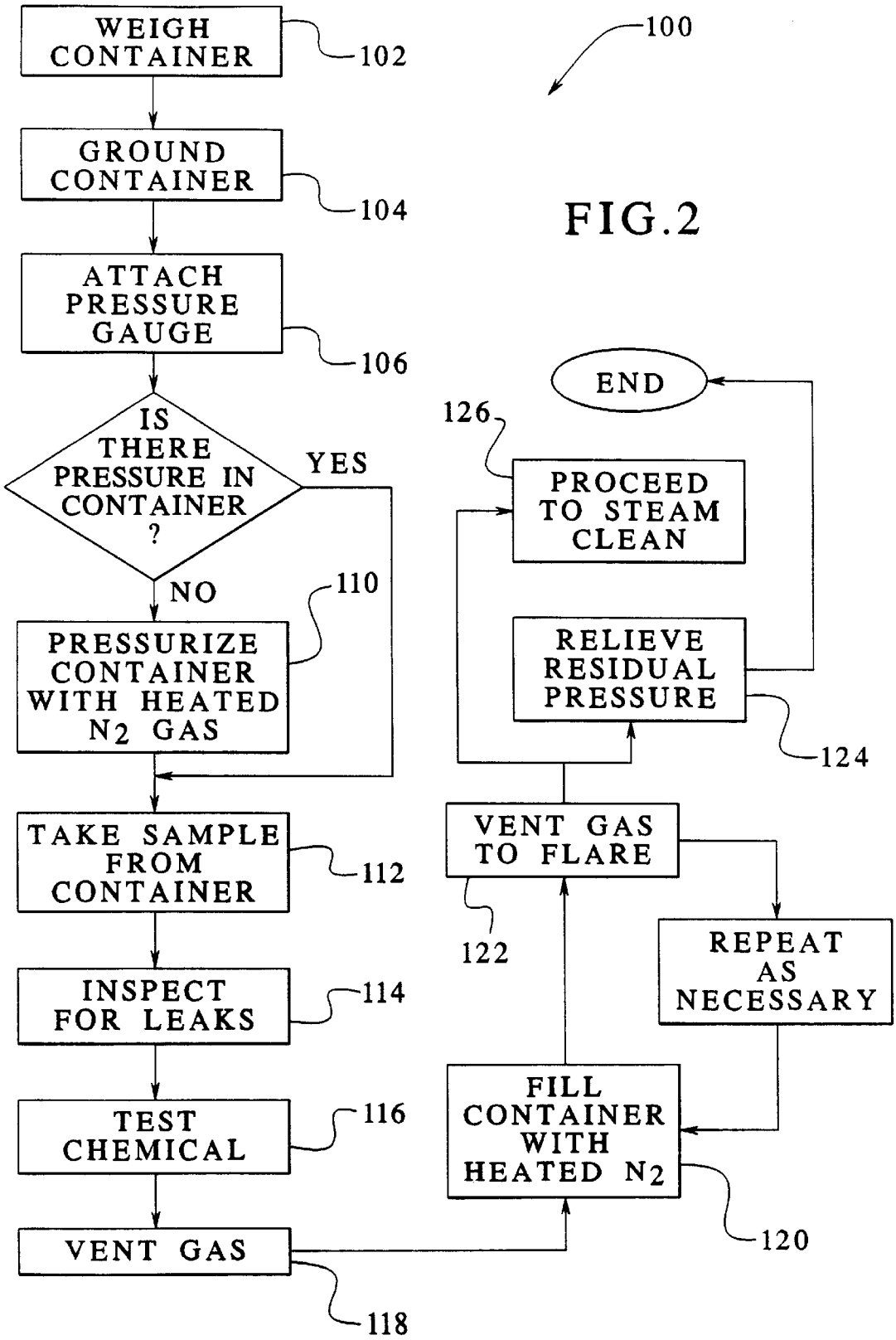
FIG. 2 illustrates a heated nitrogen gas cleaning process for the pressurized containers.
Figure 3:
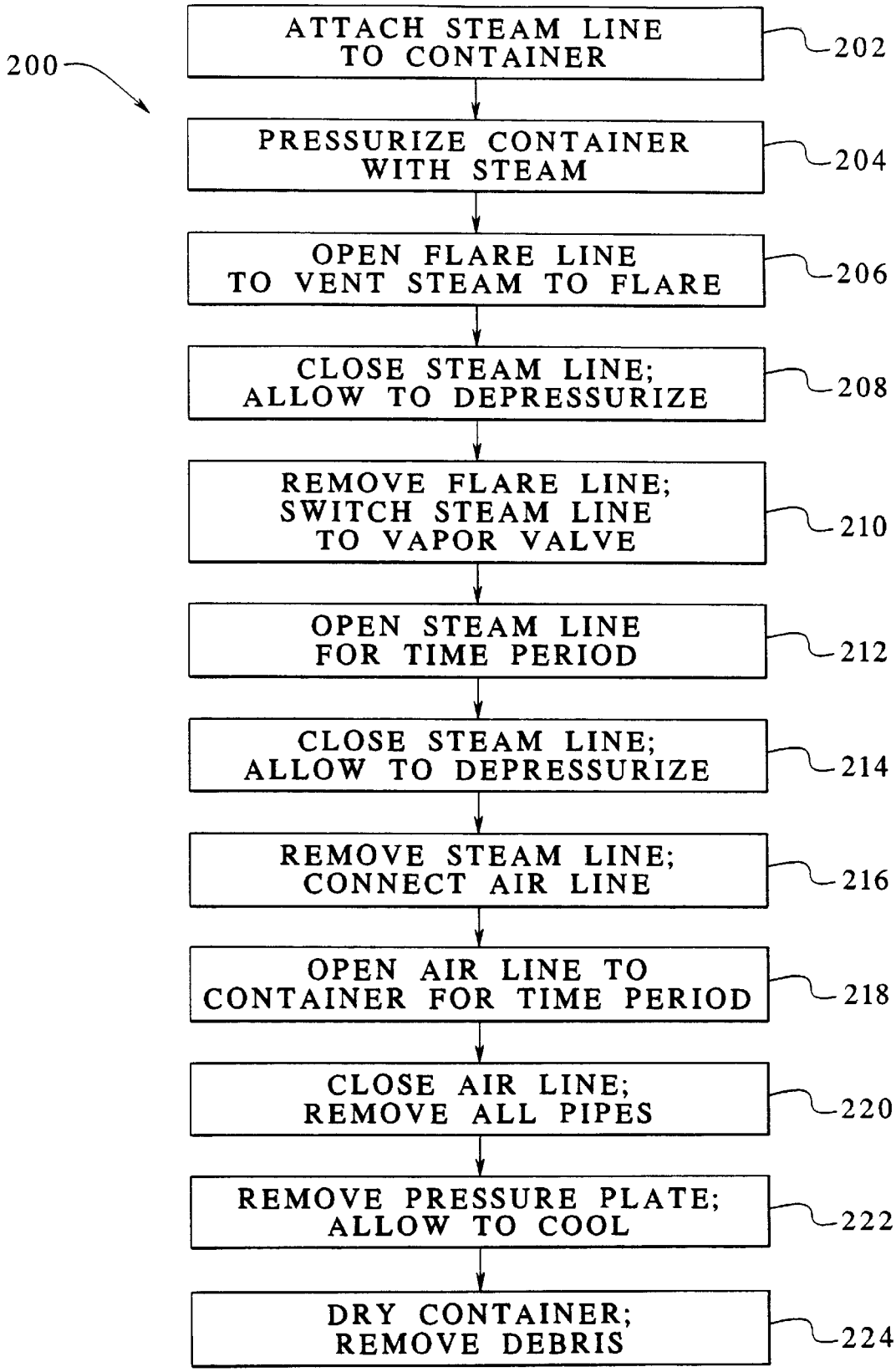
FIG. 3 illustrates a steam cleaning process for the pressurized containers to be conducted after the heated nitrogen process.
Figure 4A:
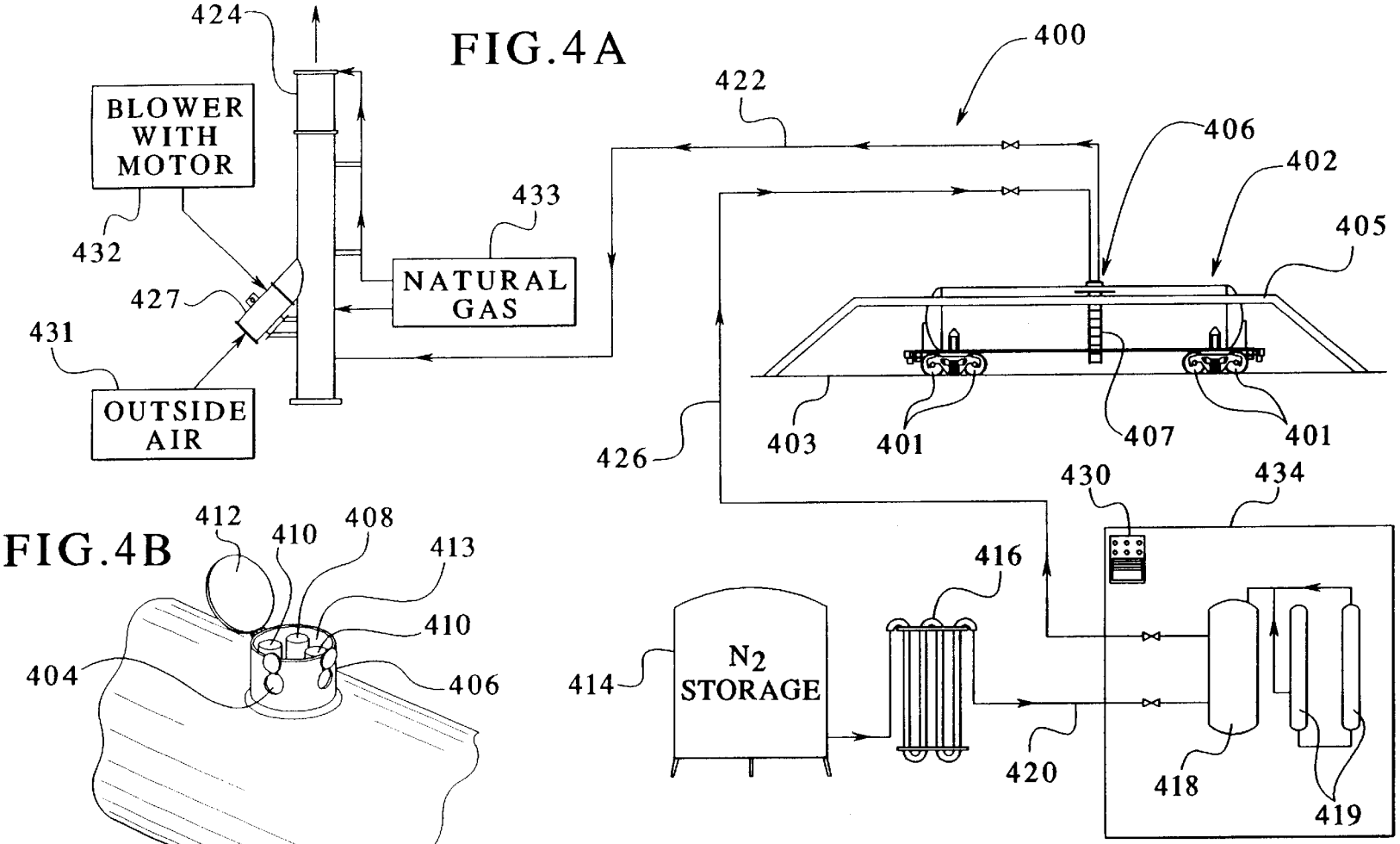
FIG. 4A illustrates a cleaning system for pressurized containers, such as, for example, for rail tank cars in an embodiment of the present invention. Further.
Figure 4B:
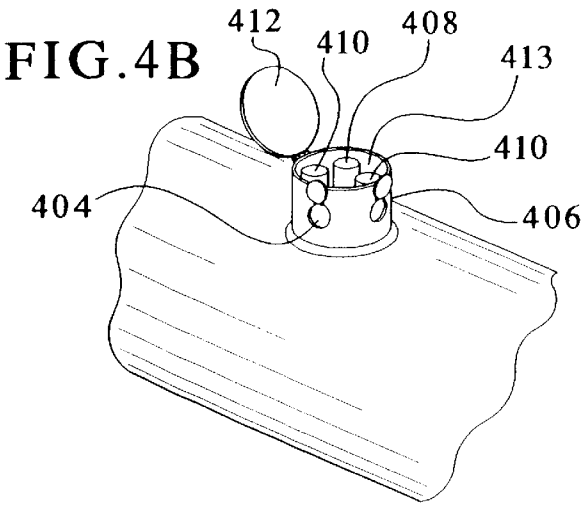
FIG. 4B illustrates a protective housing, headspace, valves and sideports situated atop a container.

Referring now to the drawings, wherein like numerals refer to like features, FIGS. 1 to 3 show three embodiments of a cleaning method according to the present invention. Further, FIGS. 4A and 4B illustrate a cleaning system for a container, such as for a rail tank car, whereby the container may be cleaned. Although this system for cleaning containers may be utilized with any pressurized container apparent to those skilled in the art, mobile or immobile, the system herein described relates specifically to rail tank cars or other mobile container situated atop a plurality of rails.

A rail tank car may include, but may not be limited to, a pressurized container 402 on a plurality of rail wheels 401 (also called a truck) allowing the container 402 to be transported on a track 403 from one location to another. It should be noted that rail tank cars may include any mobile container apparent to one skilled in the art. Typical rail tank car containers may have a protective housing 406 atop the container 402. The protective housing 406 have a plurality of valves 408,410 (as shown in FIG. 4B) contained therein for attaching pipes or lines thereto. Valve 408 may be a vapor-type valve that may typically be utilized to remove vapors from the container 402. The valves 410 may be liquid-type valves that may allow a liquid chemical to be added or removed from the container. Typically, the liquid valves 410 may be connected to pipes that may go to the bottom of the container 402. Alternatively, the vapor valve 408 maybe connected to a pipe that merely goes to space near the top of the container 402. Although many rail tank cars may have only three valves within the protective housing 406, this invention should not be limited in that regard. Any number and type of valves may be contained within the protective housing 406. Moreover, the valves need not be located only within the protective housing. Valves may be located in any location on the container 402 to remove or add materials to the container 402.

A pressure plate (not shown) may be included within the protective housing 406 that may be openable to allow an individual to gain access to an interior of the container 402. The pressure plate may be disposed on the bottom of the protective housing 406 and may be fixed to the container 402 via bolts (not shown). When an individual wishes to gain access to the interior of the container 402, the pressure plate may be removed by removing the bolts. To remove the pressure plate, the protective housing 406 and valves 408, 410 should be removed from the container 402. However, the pressure plate may be disposed anywhere on the container 402 as may be apparent to those skilled in the art.

The protective housing 406 may be opened via a lid 412 to gain access to the valves 408,410 and headspace 413 that may be contained therein. Further, the protective housing 406 may have at least three sideports 404 for gaining access to the valves 408,410 within the protective housing 406 without opening the protective housing 406 by the lid 412.

The container 402 may contain any chemical or chemicals that may be apparent to those skilled in the art. Further, the chemicals may be of a hazardous nature that may pose a risk to individuals exposed to the chemical. Specifically, the chemical or chemicals may typically be in gaseous form when under standard temperature and pressure. However, the chemical or chemicals may be a liquid when stored under pressure within the container 402. Typical chemicals that may be stored within the container may include, but may not be limited to, liquefied petroleum gas ("LPG") and/or anhydrous ammonia ("AA"). LPG may include, but may not be limited to, the following chemicals: butane, isobutane, propane, propylene, butylenes and other chemicals apparent to those skilled in the art. Hawley's Condensed Chemical Dictionary 703 (12th ed. 1993). Moreover, LPG may include mixtures of these materials. LPG is typically extremely flammable when in gaseous form. Moreover, other chemicals that may be stored within the containers that may be cleaned using the system and methods described herein may be butadiene, butene, butyne, cyclobutane, cyclopropane, dimethyl propane, ethane, ethylene oxide, propyne, ethylene, methyl butene, methyl ether, methyl propene, 1,3-pentadiene and other chemicals apparent to those skilled in the art.

Referring now to FIG. 1, an inspection process 1 is shown that may be instituted prior to cleaning the container 402 via the cleaning process described herein with reference to FIGS. 2 and 3. The container 402 may be carefully preliminarily inspected via a "search container" step 10. Specifically, an inspector may move around the container 402 looking for evidence of leakage of the chemicals via step 12. Leaks may be apparent by wet spots, corrosion in a particular area, hissing or the like. Of course, the inspector should wear applicable safety clothing and equipment and approach the container from upwind to protect the inspector from the deleterious effects of any leaking chemical. Further, the inspector may use a catwalk 405 or other structure to allow the inspector to inspect all areas of the container 402 including the top of the container 402. Likewise, the inspector may use a ladder 407 to get relatively close to the protective housing 406 and the valves 408, 410 contained therein. This preliminary inspection may be done by visually searching for leaks around the container 402 and any valves or pipes protruding therefrom. If the inspector sees evidence of leakage, then the process 1 may be halted while the inspector or other individual assesses the leak via step 14. The container 402 may be submitted to a repair facility to repair the leak prior to continuing the process 1.

If, however, the inspector sees or otherwise has detected no indication or evidence of leakage from the container 402 via the "search container" step 10, the inspector may sample one or more of the sideports 404 via step 16 using a leak detection device. The sideport 404 may allow an individual to gain access to the valves within the protective housing 406 without opening the protective housing 406 and exposing the individual to a large amount of the chemicals that may be contained within the headspace 413.

For example, an apparatus may remove a sample of gas from one of the sideports 404 via step 16 to determine if there is a leak in a valve or seal within the protective housing 406. The apparatus may include any device capable of determining a chemical composition of a volume of air, such as, for example, a Draeger® detector or a multi-gas tester manufactured by Industrial Scientific Corporation ("ISC"). A Draeger® detector may measure the chemical composition in ppm. The multi-gas tester may detect an oxygen "lower explosion limit" ("LEL") of a volume of gas. The multi-gas tester may test for the LEL by creating a combustion of the gas in the sample and sensing the heat produced. The heat produced is directly related to the percent LEL of the sample.

If there is evidence of a leak at the sideport 404, an assessment may be made via step 14 concerning whether the container 402 may be cleaned or whether the container 402 should be submitted for repairs. However, if there is no evidence of leaks from the sideport 404, then the seal of the inspector's face mask may be broken so that the inspector may test for odors via step 20 at the sideport 404. If there is evidence of a leak then the leak may be assessed via step 14. For safety purposes, however, the inspector may not break the seal of his or her facemask to test for odors.

If there is no evidence of a leak or leaks during step 20, then the inspector's facemask may be completely removed and the protective housing lid 412, as shown in FIG. 4B, may be opened. The headspace 413 and the valves 408,410 may be inspected visually via step 24. The inspector may note the valve types and damage to the valves, pipes, and/or fittings contained within the protective housing 406. If there is substantial damage to any valve, pipe or fitting or to the container 402 itself, the damage may be assessed via step 14 and a decision may be made as to whether the cleaning process should be continued. If the container 402 passes the inspection, then a cleaning process 100 may begin, as shown in FIG. 2.

Referring now to FIG. 2, a cleaning process 100 is illustrated. The cleaning process 100 may be utilized to clean the container 402 having an amount of a chemical therein. Specifically, the cleaning process 100 may be used to clean containers having LPG or AA, however any chemical or mixture of chemicals may be contained within the container as may be apparent to those skilled in the art.

The container 402 may have a tare weight printed in an accessible location, such as, for example, on a side of the container for easy visual access. The container 402, having been inspected for leaks pursuant to the inspection process 1 as shown in FIG. 1, may be weighed via a "weigh container" step 102 and compared against the tare weight of the container 402 to determine a weight of the chemical contained therein. The amount of chemical is important to make projections concerning how the container 402 may be cleaned and how long the cleaning process may take to get the chemical out of the container 402. Alternatively, the "weigh container" step 102 may be skipped.

After the container 402 is weighed, it may be grounded via step 104 to minimize the possibility of a spark being generated that may ignite the hazardous chemical contained therein. Specifically, a ground wire may be connected to a ground lug on the container 402 or in any other locations apparent to a person having ordinary skill in the art.

After the container 402 is grounded, a pipe and a pressure gauge (not shown) may be attached to the vapor valve 408 via step 106. The vapor valve 408 may then be opened slowly to pressurize the gauge allowing an individual to note and record the pressure contained within the container 402. It should be noted that the valves 408,410 on the container 402 and pipes attached to the container 402 may be any size and/or shape that may be apparent to those skilled in the art. The pressure gauge may indicate whether there is residual pressure of the chemicals within the container 402. If there is residual pressure within the container 402, then a sample may be removed from the container 402 via step 112. However, if there is no residual pressure within the container 402, then the container may be filled with nitrogen gas through one of the liquid valves 410 and the container 402 may be filled to a known pressure via step 110 so that a sample of the nitrogen/chemical mixture may be taken from the container 402 via step 112. The pressure after addition of the nitrogen gas via step 110 may be above about 0 psi and below about 12 psi after nitrogen is added thereto. However, about 6 psi is preferable for removing a sample therefrom.

The nitrogen that may be used to fill the container 402 in step 110 or that may be added to clean the container 402 may be heated before entering the container 402. Heating the nitrogen serves the purpose of providing a large volume of nitrogen gas to aid in cleaning the container 402. Further, heating the nitrogen ensures that no liquid nitrogen enters into the container 402 to damage parts of the container 402. For example, liquid nitrogen may freeze important parts such as valves and pipes and further may cause the walls of the container to freeze and crack. As shown in FIG. 4A, the nitrogen may be stored in a tank 414 and allowed to flow through a nitrogen vaporizer 416. Generally, the nitrogen vaporizer uses ambient temperatures to convert the liquid nitrogen into the gas phase. However, ambient temperatures may be relatively low depending upon where the system is located. Therefore, the nitrogen may then be vaporized by the addition of heat. The nitrogen may flow to a steamer 418 via a pipe 420 where the pipe 420 may be heated by steam to a desired temperature. The steam itself may be heated by boilers 419. Typically, the nitrogen gas may be between 100° F. and 300° F. but may preferably be 200° F. The nitrogen, however, should be at least 100° F. or above to ensure that no liquid nitrogen flows into the container 402. The temperature of the nitrogen gas may be verified using a thermometer prior to entering the container 402. The heated nitrogen gas may then be added to the container 402 via an input line 426.

After the heated nitrogen gas is added to the container 402 to a pressure of about 6 psi via step 110 or if there already is residual pressure within the container 402, a sample of the chemical may be removed from the container 402. The pressure within the container 402, either residual or added via step 110, may allow the sample to be withdrawn from the container 402. The sample may be withdrawn from any valve or pipe.

The container 402 may again be inspected for leaks via step 114. If a leak is detected around the protective housing area and the reading is about 10% or more of the LEL for liquefied petroleum gas or over about 50 ppm for anhydrous ammonia, then the leak must be assessed to determine whether the container should be removed from the cleaning process. If no leak is detected, then the vapor valve 408 may be closed and the pressure gauge may be removed.

The sample taken from the container 402 may be sampled, tested and verified via step 116. Specifically, a "commodity sampling device" ("CSD") may preferably be connected to the pipe leading from the vapor valve 408. However, the sample may be taken as noted with respect to step 112, from any pipe or valve having direct access to the interior of the container 402. The vapor valve 408 may then be opened to allow vapors within the container 402 to flow to the CSD. An amount of vapor, preferably enough to fill the sampling device to half full, may then be removed from the container 402. The CSD may be a Draeger® apparatus or any other sampling device and may be utilized to verify the identity of the contents of the container 402. This verification may ensure that the chemical or chemicals contained therein are properly identified and, therefore, handled safely and properly during the cleaning of the container 402. If the pressure of the chemical is over a predefined level, such as preferably 100 psi, or if the weight of the chemical within the container is above a predefined level, such as preferably 2000 pounds, then the container 402 may be removed from the cleaning process.

After the chemical material's identity has been verified via step 116, the vapor valve 408 may be attached to a flare line 422. For example, the flare line 422 may be attached to a hammerlock fitting that is on a 2" attached to the vapor valve 408. However, the flare line 422 may be attached to the vapor valve 408 in any way apparent to one having ordinary skill in the art. The flare line 422 may run from the container 402 to a flare 424, as shown in FIG. 4A. The flare 424 may ignite to form a flame using ignited natural gas 433 as a pilot. Highly combustible chemicals, such as LPG, may be fed directly into the flare 424 and incinerated using the flame of the pilot to ignite the chemicals. However, a flare ring may be ignited using the natural gas 433 to fully combust less combustible materials, such as AA. As shown in FIG. 4A, the flare line 422 may allow the chemical to be fed into the flare 424 causing the hazardous chemical to be incinerated as it passes through the flare. Further, outside air 431 may be fed into the flare 424 using a blower with a motor 432 to aid in the burning of the hazardous chemical within the flare 424. Typically, the blower with the motor 432 may be utilized to aid in the burning of less combustible materials, such as, for example, AA or higher combustible materials at low concentrations. To ensure complete burning of the chemicals within the flare 424 the blower with the motor 432 and the flare ring may be used together. Further, the blower may be used with highly combustible materials such as LPG for smokeless operation of the flare 424. The flare 424 may be engineered to burn a plurality of different chemicals, such as, preferably, liquefied petroleum gas and anhydrous ammonia. For example, a flare engineered and provided by Tornado Technologies Inc. may be used in this invention for the burning of chemicals such as LPG and AA.

The vapor valve 408 may then be opened to allow the gas contained therein to vent to the flare 424 thereby incinerating the residual gas contained within the container 402 via step 118. During this process, the container may again be inspected for leaks. If the chemical detection meter shows a level of the chemical at a given level, such as preferably about 75% of the LEL for liquefied petroleum gas or about 50 ppm for anhydrous ammonia, then the leak should be assessed. Based on the severity of the leak, the container may be taken from the cleaning process for repairs. As the pressure is relieved and the gas is released, the chemical therein may be vented to the flare 424. When the pressure within the container 402 reaches a predetermined level, such as between about 0 psi and about 6 psi and preferably about 3 psi, then the vapor valve 408 may be closed. An indicator light (not shown) may show when the pressure within the container 402 reaches the predetermined level.

At this point, the heated nitrogen line 426 may be attached to one of the liquid valves 410 while the flare line 422 remains connected with the vapor valve 408. A pressure gauge may be attached to the other liquid valve 410. The heated nitrogen may then be added to the container 402 via step 120 to raise the pressure within the container 402 to a desired value. The desired value may be between about 10 psi and about 30 psi and preferably about 18 psi although any pressure is contemplated that may be apparent to those skilled in the art. The vapor valve 408 may then be opened releasing the gas to the flare 424 via step 122 thereby incinerating the chemicals that may be contained therein. When the pressure reaches a desired value between about 0 psi and about 6 psi, preferably about 3 psi, the vapor valve may be closed.

The addition of heated nitrogen to the container 402 via step 120 and the subsequent venting to the flare 424 via step 122 may be repeated as desired so that the concentration of the chemical within the container 402 may reach a desired level. If the container 402 is not to be steam cleaned and is to be used to store and/or carry the same type of chemical that it had previously stored and/or carried and the concentration of the chemical therein has reached the desired level, then the residual pressure within the container 402 may be vented to the flare 424 via step 124 and the container 402 may be detached from all pipes and/or lines. It should be noted if the container 402 is not to be steam cleaned, a preferable concentration level of chemical within the container may be about 50% of the LEL for the liquefied petroleum gas or about 10,000 ppm for anhydrous ammonia. Typically, it may take a plurality of cycles of nitrogen gas to clean the container 402 to the desired level. For example, it may take six or more cycles to reach the desired level. However, any number of cycles may be performed as may be apparent to those skilled in the art. The container 402 may then be removed from the cleaning area and may be repaired or transported away.

However, if the container 402 is to transport and/or store a different chemical than previously contained therein then the container 402 should be steam cleaned via the steam cleaning process 200 shown in FIG. 3. Further, if the pressure plate (not shown) on the container 402 is to be removed (for example, to thoroughly clean therein with steam, as shown in FIG. 3), then the container 402 may be cleaned using heated nitrogen gas twice before the pressure plate is removed and the container 402 is steam cleaned.

Prior to steam cleaning via a process 200 shown in FIG. 3, the container 402 may first be prepared for the steam cleaning. For example, a rail tank car may have a magnetic gauging device rod that may be removed or it may get damaged during the steam cleaning. In addition, other devices may be removed from the container 402 in preparation for the steam cleaning process 200.

After the container 402 is prepared for the steam cleaning, a steam line (not shown) may be attached to the liquid valve 410 via step 202 for adding steam to the container 402. The liquid valve 410 may then be opened to pressurize the container 402 with steam to a desired pressure via step 204. An adequate range of pressure may be between about 10 and about 20 psi, preferably about 15 psi. Alternatively, the container 402 may be pressurized for a period of time, preferably about three minutes. The vapor valve 408 having the flare line 422 attached thereto may be opened to vent the steam to the flare 424 via step 206. Residual chemicals that may still be contained within the container 402 may thereby be removed. The steam may be vented through the container 402 for a desired period of time, preferably about 30 minutes, to thoroughly clean the interior of the container 402. After the desired period of time, the liquid valve 410 may be closed allowing the container 402 to depressurize via step 208. The flare line 422 may be removed via step 210 and the steam line may be moved from the liquid valve 410 to the vapor valve 408.

Pipes may be attached to the liquid valve 410 and may allow the steam flowing therethrough to be vented directly to the atmosphere. After the liquid valve 410 and vapor valve 408 have been opened, the container 402 may be steamed via step 212 for a desired period of time, preferably about 3 or 3½ hours. The waste steam may be vented through a pipe attached to the liquid valve 410.

After the container 402 has been steamed for the desired period of time via step 212, then the vapor valve 408 may be closed, and the steam therein allowed to vent to the atmosphere thereby depressurizing the container 402 via step 214. The steam line (not shown) may be removed and an air line (not shown) may be attached to the vapor valve 408 via step 216. The vapor valve 408 may be opened and dry, cool air may be allowed to flow through the container 402 for a desired time period, preferably 30 minutes, via step 218 to allow the container 402 to become dry and cool.

After the desired time period is over, the vapor valve may be closed and all lines may be removed via step 220. The pressure plate (not shown) on the container 402 may be removed and the container 402 further allowed to cool via step 222. Finally, after the container 402 is cooled, the container 402 may be allowed to dry. Debris, such as residual scale and other deposits, may be removed via step 224 by fitting an individual within the container 402 with equipment to remove the debris.

The addition of heated nitrogen and steam and the subsequent venting of gases via the processes 1, 100 and/or 200 may be controlled by a control panel 430 having buttons, switches, lights, warnings, or any other controls or displays that may inform a user and allow a user to control the processes 1, 100 and/or 200 described above.

It should be noted that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A method of cleaning a container having at least one chemical therein, the method comprising the steps of:

providing a container having an amount of at least one chemical contained therein wherein the container has a plurality of valves for adding material to the container or removing material from the container;

adding an amount of heated nitrogen gas to the container to mix with the chemical creating a nitrogen gas/chemical mixture;

providing a flare to incinerate the nitrogen gas/chemical mixture; and venting the nitrogen gas/chemical mixture to the flare.

2. The method of claim 1 wherein the chemical is in a gaseous state at standard temperature and pressure and further wherein the chemical has a pressure within the container.

3. The method of claim 2 further comprising the steps of:

measuring the pressure within the container prior to adding the heated nitrogen gas; and venting the nitrogen gas/chemical mixture to the flare.

4. The method of claim 1 further comprising the step of:

inspecting the container for leaks.

5. The method of claim 1 further comprising the step of:

sampling the hazardous material to verify the identity of the chemical.

6. The method of claim 1 further comprising the step of:

attaching a pipe to one of the valves and connecting the pipe to the flare prior to venting the residual pressure of the chemical.

7. The method of claim 1 further comprising the steps of:

providing a housing having sideports wherein the housing is disposed over the valves; and sampling the gas within the housing for leaks via the sideports of the housing while inspecting the container.

8. The method of claim 7 further comprising the steps of:

providing a lid on the housing;

opening the lid; and inspecting the valves in the housing for damage to the valves.

9. The method of claim 1 wherein the temperature of the heated nitrogen gas is between about 100° F. and about 300° F.

10. The method of claim 1 further comprising the step of:

attaching a pipe from the nitrogen gas to the inlet valve of the container.

11. The method of claim 1 further comprising the steps of:

filling the container with heated nitrogen gas;

venting the heated nitrogen gas from the container; and repeating the filling and the venting a plurality of times until the concentration of the chemical therein reaches a predefined amount.

12. The method of claim 1 further comprising the step of:

adding heated nitrogen gas until the pressure within the container is between about 5 psi and about 50 psi.

13. The method of claim 1 further comprising the step of:

grounding the container prior to inspecting the container.

14. The method of claim 1 further comprising the steps of:

providing a means to access the inside of the container; and opening the means to access the inside of the container to gain access to the inside of the container.

15. The method of claim 1 further comprising the steps of:

providing steam in a steam tank;

connecting a pipe from the steam tank to the inlet valve of the container;

adding the steam to the container to pressurize the container with the steam; and maintaining the pressure of the steam within the container for an amount of time.

16. The method of claim 1 further comprising the steps of:

measuring a residual pressure of the chemical within the container with a pressure gauge prior to adding the amount of heated nitrogen gas; and venting the residual pressure of the hazardous material to the flare.

17. The method of claim 16 further comprising the step of:

adding a quantity of heated nitrogen gas if the residual pressure within the container is about zero psi.

18. The method of claim 1 wherein the container is a rail tank car.

19. The method of claim 1 wherein the container has a plurality of chemicals contained therein.

20. The method of claim 1 further comprising the step of:

providing a control panel having a plurality of controls for controlling the cleaning method; and controlling the cleaning method via the control panel.

* * * * *